US010669119B2

(12) United States Patent
Ewing et al.

(10) Patent No.: US 10,669,119 B2
(45) Date of Patent: Jun. 2, 2020

(54) DEPLOYMENT SYSTEM

(71) Applicant: FAUN Trackway Limited, Isle of Anglesey (GB)

(72) Inventors: Rob Ewing, Isle of Anglesey (GB); Gareth Williams, Isle of Anglesey (GB)

(73) Assignee: FAUN Trackway Limited, Isle of Anglesey (GB)

( * ) Notice: Subject to any disclaimer, the term of this patent is extended or adjusted under 35 U.S.C. 154(b) by 195 days.

(21) Appl. No.: 15/277,552

(22) Filed: Sep. 27, 2016

(65) Prior Publication Data

US 2017/0158456 A1 Jun. 8, 2017

(30) Foreign Application Priority Data

Dec. 2, 2015 (GB) ..... 1521274.9

(51) Int. Cl.
*B65H 75/42* (2006.01)
*B65H 75/44* (2006.01)
(Continued)

(52) U.S. Cl.
CPC ..... *B65H 75/425* (2013.01); *B65D 85/672* (2013.01); *B65D 88/121* (2013.01);
(Continued)

(58) Field of Classification Search
CPC .... B65H 75/42; B65H 75/447; B65H 75/425; B65H 75/4402; B65H 2701/1922;
(Continued)

(56) References Cited

U.S. PATENT DOCUMENTS 4,103,841 A 8/1978 Flynn et al.
4,663,145 A 5/1987 Van den Berk et al.
(Continued)

FOREIGN PATENT DOCUMENTS

CN 201411622 Y 2/2010
CN 203112258 U 8/2013
(Continued)

OTHER PUBLICATIONS

Wikipedia: ISO 668; Jul. 26, 2015; https://en.wikipedia.org/w/index.php?title=ISO_668&oldid=673127417 (Year: 2015).*
(Continued)

*Primary Examiner* — Michael R Mansen
*Assistant Examiner* — Raveen J Dias
(74) *Attorney, Agent, or Firm* — Meister Seelig & Fein LLP; Seth H. Ostrow, Esq.

(57) ABSTRACT

Apparatus for deployment, recovery and/or storage of a resource comprising a flexible length of equipment capable of being wound on a spool, the apparatus comprising a rigid container shaped and configured to be handled by a specified vehicle type, the container having at least a base and a pair of opposing end walls, and an open side or an opening in a side wall thereof, wherein, on said base between said opposing end walls, there is provided a mounting member on which said spool is or can be mounted for rotation about its longitudinal axis. In an exemplary embodiment, the external dimensions of said container conform to the ISO 668 International Standard, and the equipment comprises a surface-covering track comprised of interconnected panels.

15 Claims, 5 Drawing Sheets

(51) Int. Cl.

| | |
|---|---|
| ***E01C 19/52*** | (2006.01) |
| ***B65D 85/672*** | (2006.01) |
| ***B65D 88/12*** | (2006.01) |
| ***B65D 90/00*** | (2006.01) |

(52) U.S. Cl.
CPC ..... *B65D 90/008* (2013.01); *B65D 90/0033* (2013.01); *B65H 75/42* (2013.01); *B65H 75/4471* (2013.01); *B65H 75/4489* (2013.01); *B65H 75/4497* (2013.01); *E01C 19/522* (2013.01); *B65H 2301/5115* (2013.01); *B65H 2406/21* (2013.01); *B65H 2701/1922* (2013.01)

(58) Field of Classification Search
CPC ..... B65D 88/12; B65D 88/22; B65D 88/121; B65D 88/122; B65D 88/123; B65D 88/127; B65D 88/128; B65D 88/129; B65D 88/672; B65D 90/008; B65D 90/0033; B65D 2588/02; B65D 2588/12; B65D 2590/091; B65D 85/02; B65D 85/66; E01C 19/522; E01C 19/52; E01C 9/08; E01C 9/083; E01C 9/086; B60P 1/6463; B60P 1/6418
USPC ..... 242/557; 220/1.5, 676, 666, 661, 601, 220/714
See application file for complete search history.

(56) References Cited

U.S. PATENT DOCUMENTS

| | | | | |
|---|---|---|---|---|
| 4,681,482 | A * | 7/1987 | Arciszewski | E01C 19/522 14/2.4 |
| 8,784,002 | B2 * | 7/2014 | Ringus | E01C 9/02 14/2.5 |
| 8,784,007 | B2 * | 7/2014 | Wilson | B09B 1/004 242/557 |
| 8,820,559 | B2 * | 9/2014 | Beitler | B65D 88/128 206/512 |
| 2001/0038009 | A1 * | 11/2001 | Payne | B65D 88/121 220/1.5 |
| 2008/0135669 | A1 * | 6/2008 | Kostigian | A47F 7/175 242/557 |
| 2009/0274516 | A1 * | 11/2009 | Colkitt | E01C 23/04 404/75 |
| 2010/0025407 | A1 * | 2/2010 | Benson | B65D 88/022 220/564 |
| 2010/0043677 | A1 * | 2/2010 | Reynard | B65D 88/129 108/55.1 |
| 2012/0067996 | A1 * | 3/2012 | Motz | E01C 13/08 242/416 |
| 2014/0230882 | A1 * | 8/2014 | Hingley | H01L 31/045 136/245 |
| 2014/0299706 | A1 * | 10/2014 | DiSabantonio, III | B65D 19/12 242/598 |
| 2015/0014207 | A1 * | 1/2015 | Boespflug | B65D 90/06 206/524.3 |

FOREIGN PATENT DOCUMENTS

| | | | | |
|---|---|---|---|---|
| CN | 105064185 | A | 11/2015 | |
| GB | 2502661 | A | 12/2013 | |
| WO | WO9909255 | | 2/1999 | |
| WO | WO2005014457 | A2 | 2/2005 | |
| WO | WO-2014005675 | A1 * | 1/2014 | B65D 90/00 |
| WO | WO2014101952 | A1 | 7/2014 | |

OTHER PUBLICATIONS

European Search Report, dated Nov. 4, 2017, European Patent Office, Europe.
Search Report under Section 17(5), dated May 27, 2016, United Kingdom Intellectual Property Office, United Kingdom.

* cited by examiner

DEPLOYMENT SYSTEM

This invention relates generally to a deployment system for coiled or rolled resources and, more particularly but not necessarily exclusively, to a method and apparatus for deployment and/or recovery of resources stored in a rolled configuration, for example, temporary roadways, temporary walkways, geotextiles, buoy cables/chains, booms, water fuel and gas hoses, fencing, and especially (but not exclusively) suitable for use in rough terrain environments.

There are many commercial and military applications in which a resource, normally stored in a rolled configuration on a spool or the like, is required to be deployed and subsequently recovered, quickly and conveniently, especially within rough terrain and/or potentially hazardous environments, where speed and efficiency are paramount.

For example, it is known, in many applications, to transport and deploy a temporary roadway system, wherein a road-covering track comprising interconnected profiled panels, is wound around a spool into a roll. In a known deployment method, the spool may be mounted, via a spool stand, on a flatbed body or trailer of a heavy goods vehicle, such that the winding axis of the spool is perpendicular to the longitudinal axis of the vehicle body. As illustrated in FIG. 1 of the drawings, the road-covering track 1 is drawn off the spool 2 and positioned under the vehicle's rear wheels 4. The vehicle 3 then reverses, causing the road-covering track 2 to be removed from the rotating spool 2 and laid onto the ground under tension.

Other methods for deployment of this type of road-covering track are also known, that employ vehicles such as a tele-handler or wheeled loader, but they all operate in much the same manner as described above, whereby a constant tensioning device is used to automatically lay the roadway in tension and the laying process is determined by the speed of the moving vehicle. An alternative method of deployment may be performed by means of a remote control device that requires the operator and driver to synchronize the speed of vehicle travel with the speed of spool rotation. The operator depresses the spool rotation button on the pendant control to correspond with the travelling speed of the vehicle. If the electrical system fails, the operator can use hydraulic manual override levers to rotate the spool and, if complete hydraulic failure occurs, the operator can operate a manual handpump to release the spool rotation and the roadway can be manually pulled from the spool and placed under the vehicle's wheels.

However, all of the above-mentioned deployment methods require the provision of a suitable vehicle to facilitate them, as well as to transport the rolled resource to the desired location, and, if such a vehicle is not normally used within the environment, the provision of such a vehicle specifically for this purpose significantly increases the cost of using the required resource and, therefore, the overall cost of an operation.

It would therefore be desirable to provide a deployment/recovery system for coiled resources of the type described above, that does not require the provision and use of a specific type of vehicle.

In accordance with a first aspect of the present invention, there is provided apparatus for deployment, recovery and/or storage of a resource comprising a flexible length of equipment capable of being wound on a spool, the apparatus comprising a rigid container shaped and configured to be handled by a specified vehicle type, the container having at least a base and a pair of opposing end walls, and an open side or an opening in a side wall thereof, wherein, on said base between said opposing end walls, there is provided a mounting member on which said spool is or can be mounted for rotation about its longitudinal axis.

In an exemplary embodiment of the invention, at least one door may be hingedly mounted on one side across said opening. The apparatus may comprise a pair of door members hingedly mounted on opposing sides of said opening. Each of said door members may comprise a first panel hingedly connected to a second panel, said second panel being hingedly mounted on a respective side of said opening. In an alternative exemplary embodiment, one or more roller, or sliding, doors may be mounted across said opening. In yet another exemplary embodiment, the container comprises a flatrack device, comprising a base and two end walls and having open opposing sides.

Apparatus according to an exemplary embodiment may comprise a container formed of corrugated weathering steel, and the external dimensions of said container may conform with the ISO 668 International Standard. The base of said container may be provided with a pair of fork pockets. Optionally, the corners of said container may each comprise a corner casting assembly.

In an exemplary embodiment, a drive system may be provided within said container for rotating said spool. The drive system may comprise a hydraulic system. The apparatus may further comprise an integral compartment for storing hydraulic connectors for said hydraulic system.

The apparatus may comprise a conduit within said housing, said conduit having an inlet adjacent a side edge of said container. In this case, the container may comprise a water hydrant connector member for enabling a water hydrant to be connected thereto, said connector member being communicably coupled to said conduit inlet. The conduit may comprise one or more apertures configured to create jets of water when a pressurized water supply is applied at said inlet of said conduit. A base of said container may be provided with one or more drainage apertures. Thus, the base of said container may comprise or include a sheet of mesh material.

In an exemplary embodiment, the container may comprise one or more storage compartments; and/or a ladder may be mounted or otherwise provided on said container, said ladder extending substantially vertically along a side wall of said container.

According to another aspect of the present invention, there is provided a method of manufacturing apparatus substantially as described above, comprising providing a rigid container externally shaped and configured to conform to the ISO 668-Series 1 freight containers International Standard, the container having at least a base and a pair of opposing end walls, and mounting on said base between said end walls, a spool on which is wound a flexible length of equipment such that said spool is rotatable about its longitudinal axis within said container.

The above-mentioned equipment may comprise a surface-covering track comprised of interconnected panels.

These and other aspects of the present invention will be apparent from the following specific description, in which embodiments of the present invention are described, by way of examples only, and with reference to the accompanying drawings, in which.

Figure 1:
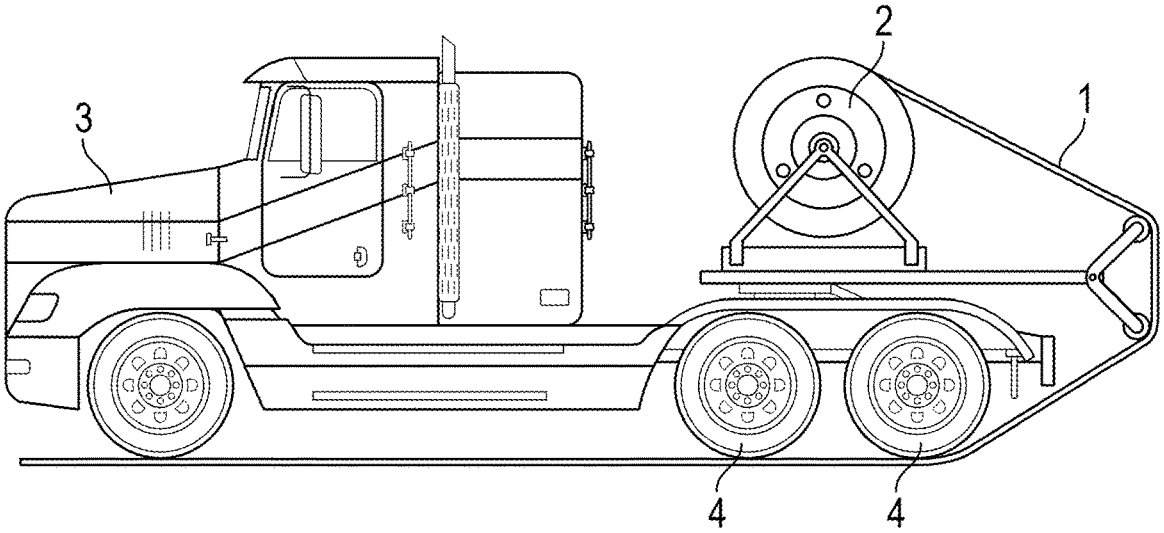
FIG. 1 (Prior Art)
FIG. 1 is a schematic perspective view of a conventional heavy goods vehicle in a method of deployment of a surface-covering trackway according to an example of the prior art.
Figure 2:
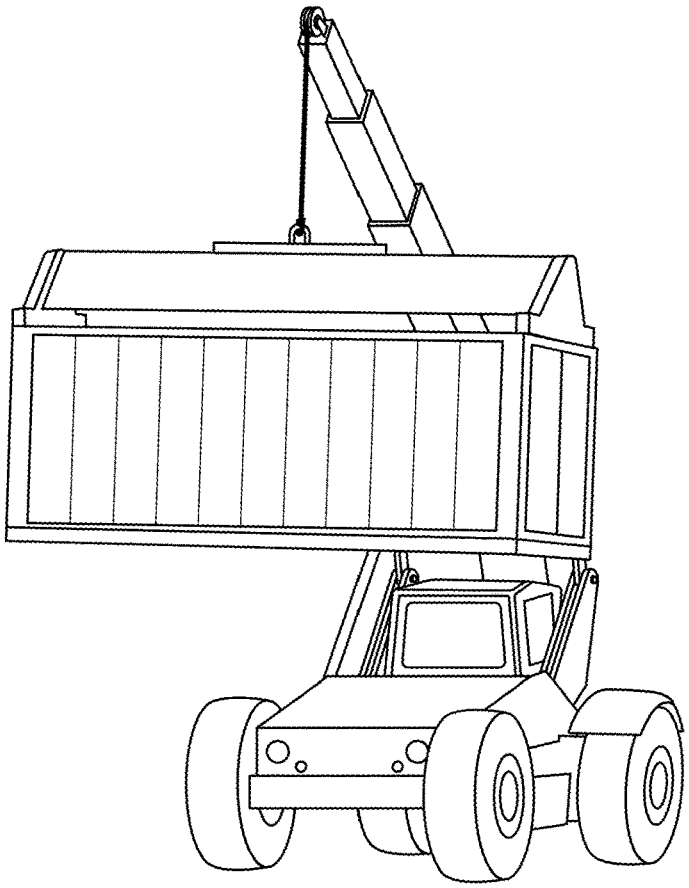
FIG. 2 (Prior Art)
FIG. 2 is a perspective view of a typical rough terrain container handling vehicle, with which an exemplary embodiment of the present invention may be used.
Figure 2A:
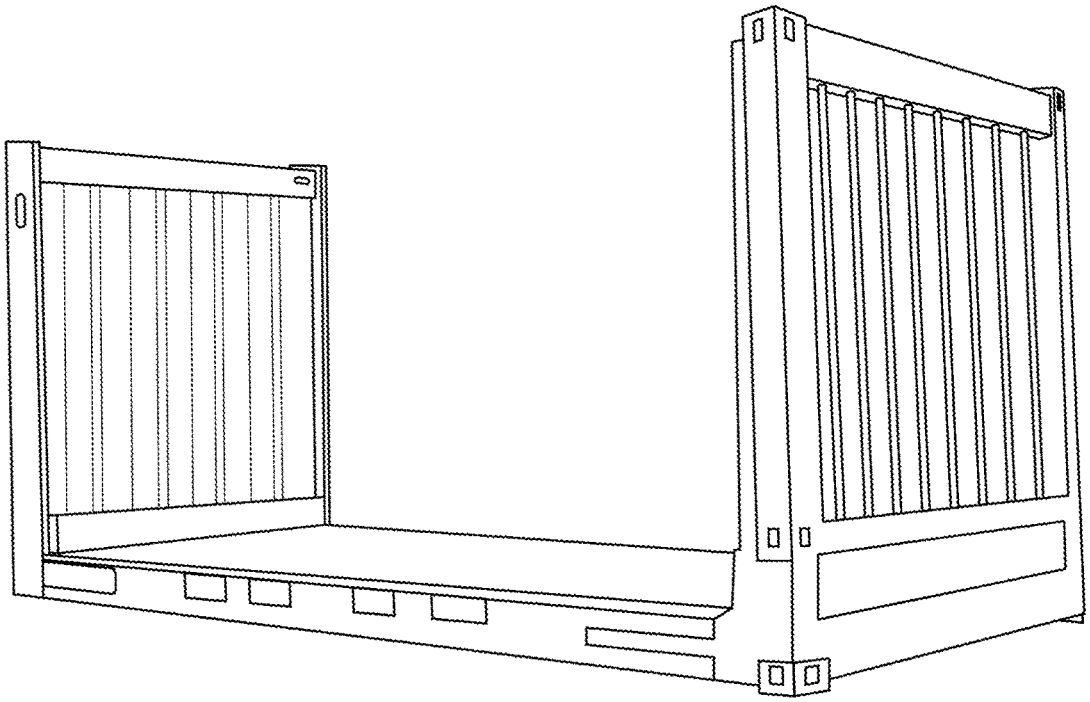
FIG. 2A (Prior Art)
FIG. 2A is a perspective view of a conventional flatrack device.

Shipping containers have been used to transport goods, resources and equipment around the world for many years. The ISO International Standard, ISO 668 Series 1 Freight Containers, classifies intermodal shipping containers and standardizes their size and weight specification, with the purpose of regulating, amongst other things, internal and external dimensions of containers, as well as minimum door opening size, where applicable. Lengths of containers vary greatly, but the most common containers in current use are the twenty and forty foot standard length boxes of the so-called dry freight design. These typical containers are rectangular, closed box models with doors fitted, either at one end or on one side, and made of corrugated weathering steel. Each of the eight corners has an essential corner casting which, together, form a standardized rotating connector for securing shipping containers, with the primary purpose of locking a container into place, and for lifting of the containers by a container handling vehicle. An alternative container, known as a flatrack, is illustrated in FIG. 2A of the drawings. As shown, this type of container comprises a base and a pair of opposing end walls only, with an open top and side 'walls'. For the avoidance of doubt, it will be appreciated that the present invention is applicable to both closed and flatrack containers and is not necessarily intended to be limited in this regard.

Many different types of container handling vehicle are known and widely used in various respective environments. For example, a large proportion of ISO 20 foot containers have fork pockets built into the base of the container, which allow forklift tines to enter under the container, and enable a standard forklift to lift it (as long as the forklift is rated to lift the payload). However, for containers that do not have integral fork pockets, or for payloads greater than those for which a forklift would be suitable, other container handling vehicles are in widespread use. Specialized container handling vehicles are also known, designed for use in specific environments and/or specific tasks and operations. For example, rough terrain container handling (RTCH) vehicles, which are designed and used to lift and move ISO shipping containers on rough terrain, on and off beach landing craft and, as such, are particularly commonly provided in military environments, where having this capability permanently available on-site is critical to an operation. A typical RTCH vehicle is shown in FIG. 2 of the drawings, by way of example and for illustrative purposes only.

Thus aspects of the present invention are intended to provide a convenient deployment system for coiled resources of the type described above, for use in environments where a container handling vehicle is readily available and additional vehicular resource is, therefore, not required to be provided in order to enable deployment and recovery of the above-mentioned resources within those environments.

Figure 3:
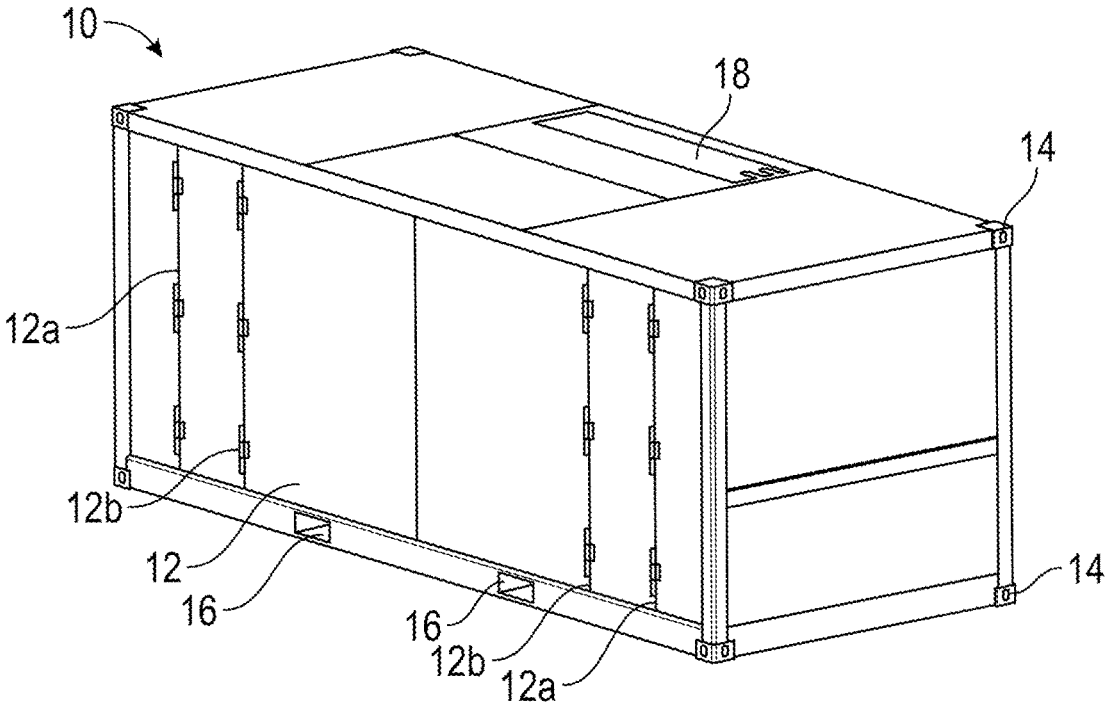
FIG. 3 is a schematic perspective front view of apparatus according to an exemplary embodiment of the present invention, with the doors thereof in a closed configuration.

Referring to FIG. 3 of the drawings, apparatus according to an exemplary embodiment of the present invention comprises a container 10 in a closed configuration. In this specific exemplary embodiment of the present invention, the container 10 is constructed to comply with the size specification for the ISO 668 1 C 2013-Series 1 freight containers International Standard in respect of a twenty foot shipping container. Thus, the container in this case is a rectangular closed box with a pair of doors 12 fitted across a door opening across one side thereof, the container having a length 30 of 6.048 m and a width and height of 2.438 m each. Each door 12 hingedly mounted across the side of the container 10 by means of a first vertical hinge member or set of hinge members 12*a*, and the doors themselves are formed of two panels hingedly mounted together by means of a second vertical hinge member or set of hinge members 12*b*. The container may be made of any suitable material, such as corrugated weathering steel, and each of the eight comers has a corner casting assembly 14, as described above. The base of the container is provided with a pair of fork pockets 16, and the upper surface of the container is formed 5 with a container section having a removable cover 18.

Figure 4:
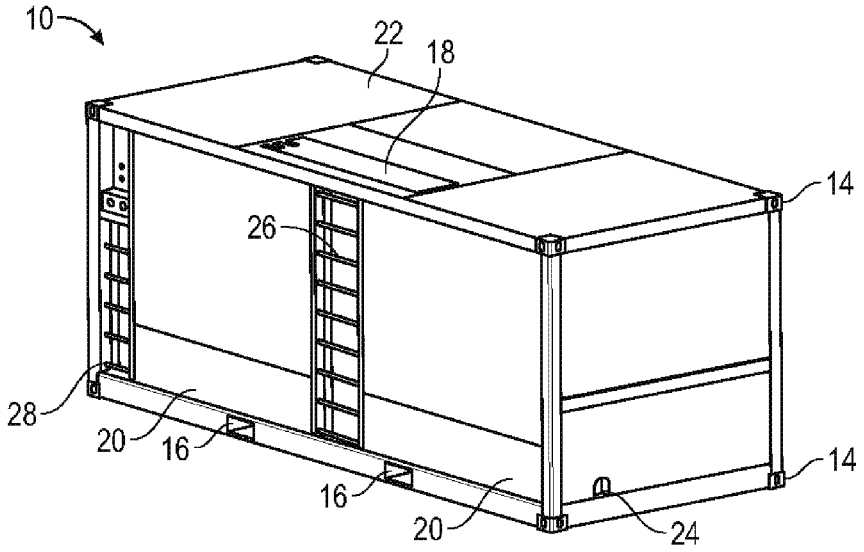
FIG. 4 is a schematic perspective rear view of the apparatus of FIG. 3.
Figure 6:
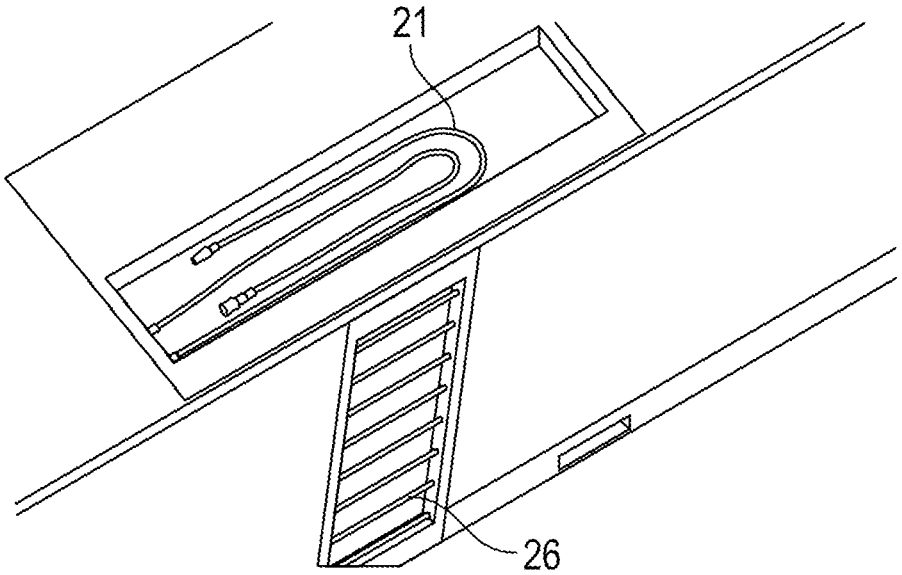
FIG. 6 is a schematic close-up partial view of the top of the apparatus of FIG. 3, illustrating the hydraulic connections of the apparatus stored in the roof of the container thereof.
Figure 7:
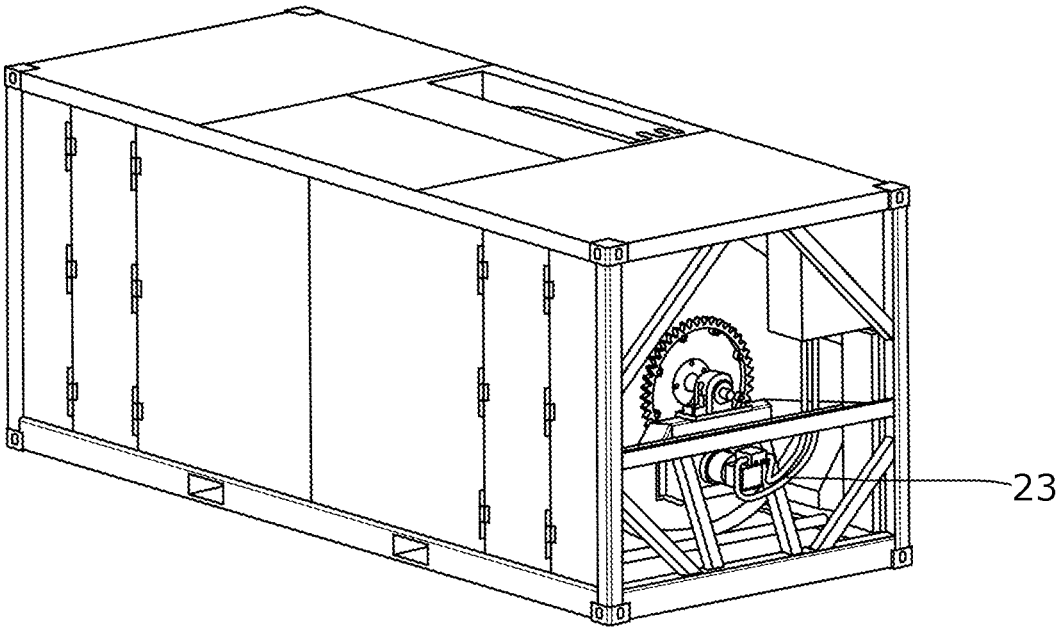
FIG. 7 is a schematic perspective view of the apparatus of FIG. 3, with the end wall removed to show the hydraulic system of the apparatus housed within the container thereof.

Referring additionally to FIG. 4 of the drawings, a pair of storage compartments 20 is provided at the rear of the container 10. As shown in FIG. 6 of the drawings, the compartment provided in the roof of the container 10 houses auxiliary hydraulic connectors 21 when they are not required for use, and, at the rear of the container 10, there is provided an access ladder 26 to enable an operative to climb to the roof of the container to access the compartment. The container 10 defines a hydraulic cabinet, denoted generally at 22, in which the hydraulic system (illustrated in FIG. 7 at 23) for driving the deployment assembly is housed, and a further access ladder 28 is provided at the rear of the container 10 to enable an operative to access the hydraulic cabinet, as required, via a cover in the roof of the container 10. A water hydrant connection 24 is provided in an end wall of the container 10 to enable water to be introduced into the container to clean the deployment assembly.

Figure 5:
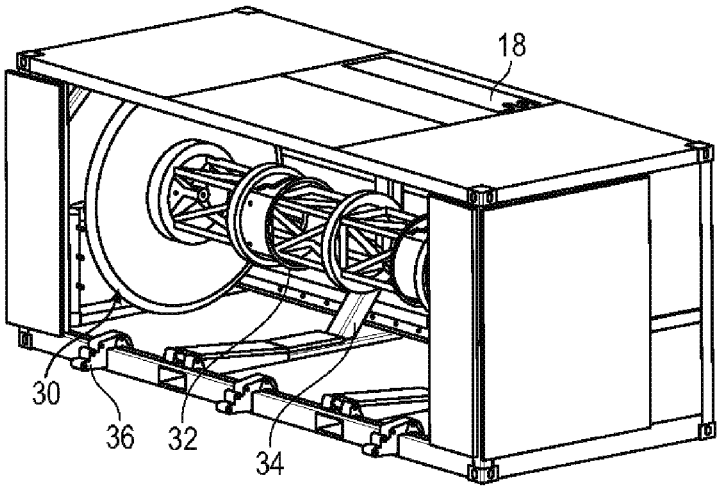
FIG. 5 is a schematic perspective front view of the apparatus of FIG. 3, with the doors open, ready for deployment.
Figure 5A:
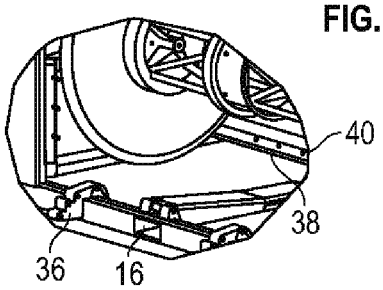
FIG. 5A is a schematic close-up view of the section marked A in FIG. 5.

Referring now to FIG. 5, within the container 10, there is housed a deployment assembly denoted generally at 30. The deployment assembly comprises a spool 32 on which the resource, such as surface-covering track (not shown) is wound, when not in use. The spool 32 comprises a pair of opposing, substantially circular end plates with a generally cylindrical support member extending therebetween, and is of substantially the same configuration as a conventional spool for this purpose. The spool 30 is mounted within the container on frame 34 so as to be rotatable therein about an axis parallel to the longitudinal axis of the container 10. A set of spaced apart guide member 36 is provided along the lower side edge of the door opening, each guide roller comprising a set of rollers mounted in side-by-side relation and configured to rotate about an axis parallel to the longitudinal axis of the container 10. A conduit 38 runs along the rear lower side edge inside the container, the conduit being formed with a series of apertures 40 arranged in spaced apart location along its length. When water is introduced into the conduit 38, under pressure, via the water hydrant connection 24, jets of water are propelled from the apertures 40 to cleaning the spool and/or the resource wound thereon. The floor of the container comprises apertures, or may be formed of mesh, in order to allow the water to drain from the container.

Figure 8:
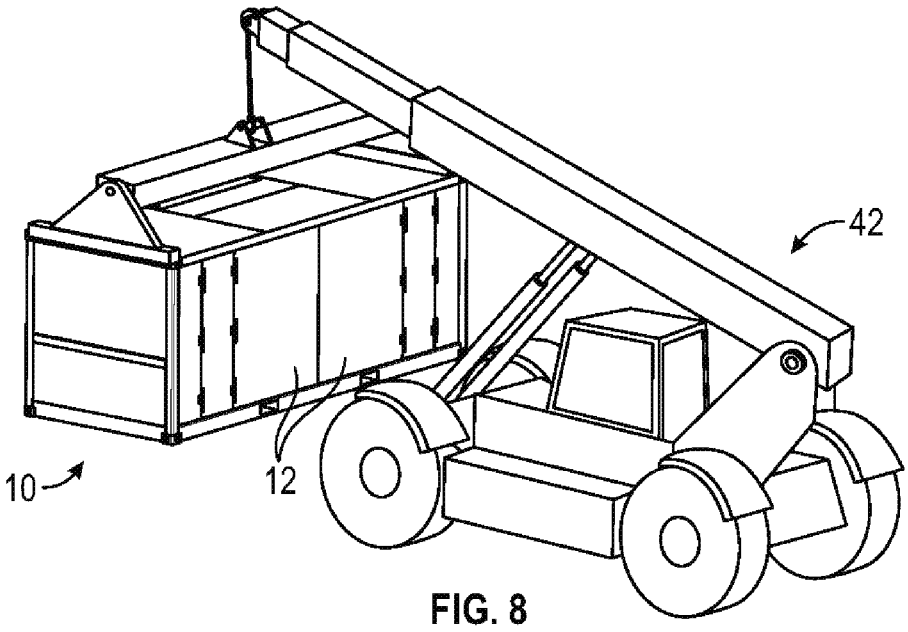
FIG. 8 is a schematic diagram illustrating the apparatus of an exemplary embodiment of the invention coupled to a rough terrain container handling vehicle.
Figure 9:
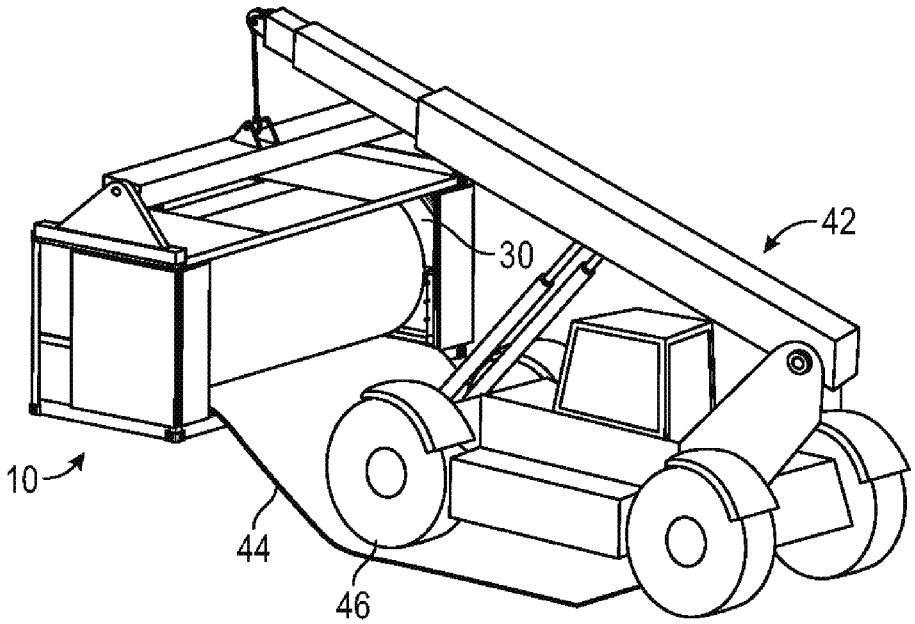
FIG. 9 is a schematic diagram illustrating apparatus according to an exemplary embodiment of the present invention, when in use to deploy a road-covering track using the rough terrain container handling vehicle of FIG. 8.

Referring now to FIGS. 8 and 9 of the drawings, in use, a rough terrain container handling (RTCH) vehicle 42 transports the container 10, including the deployment assembly, to a desired location. During transportation, the container 10 is oriented such that the doors 12 of the container face the vehicle 42. At the desired location, the container 10 is lowered to the ground and the doors 12 are opening. The hydraulic power system is used to power the spool 30, causing it to rotate and feed the road-covering track 44 from the spool 30. The end of the road-covering track 44 is placed under the front wheels 46 of the vehicle and the vehicle is then driven forward, over the road-covering track 44 to pull the road-covering track from the spool and lay it, under tension, on the ground. It will be appreciated that other methods of deployment of the road-covering track (or other resource wound on the spool) can be used, as described above, and the present invention is not necessarily intended to be limited in this regard.

It will be appreciated by a person skilled in the art, from the foregoing description, that modifications and variations can be made to the described embodiments, without departing from the scope of the invention as defined by the appended claims. For example, it will be appreciated that the invention is not necessarily limited to the size of the container—the size of the container is limited only by the specification and capabilities of the vehicle required to transport and deploy the resource held therein. Furthermore, a preferred method of deployment is described above, but it will be appreciated that the method of operation of the apparatus of the present invention is not necessarily intended to be limited in this regard. Thus, in the above-described method, a constant tensioning device is used to automatically lay the roadway in tension and the laying process is determined by the speed of the moving vehicle. However, an alternative method of deployment may be performed by means of a remote control device that requires the operator and driver to synchronize the speed of vehicle travel with the speed of spool rotation. The operator depresses the spool rotation button on the pendant/joystick control to correspond with the travelling speed of the vehicle. If the electrical system fails, the operator can use hydraulic manual override levers to rotate the spool and, if complete hydraulic failure occurs, the operator can operate a manual handpump to release the spool rotation and the roadway can be manually pulled from the spool and placed under the vehicle's wheels.

The invention claimed is:

1. Apparatus for deployment, recovery and/or storage of a roadway, the apparatus comprising:

a rigid container, the external dimensions of which conform to ISO 668 Series 1 freight containers International Standard, the container having at least a base, a pair of opposing end walls, and at least an open side or an opening in a side wall thereof, for deployment and/or recovery of the roadway, wherein, on said base between said pair of opposing end walls, there is provided a frame that serves as a mounting member;

a spool mounted on the frame for rotation about its longitudinal axis, the spool comprising the flexible length of surface-covering roadway, the roadway being configured to be deployed from the spool as a vehicle is driven over the roadway, the vehicle acting to pull the roadway from the spool and lay the roadway under tension on a ground; and at least one corner casting assembly configured at corners of the container that enable the container to be lifted by a container handling vehicle.

2. Apparatus according to claim 1, wherein said container comprises the opening in the side wall thereof and at least one door is hingedly mounted across one side of said opening.

3. Apparatus according to claim 2, wherein said at least one door comprises a pair of door members hingedly mounted on opposing sides of said opening.

4. Apparatus according to claim 3, wherein each of said pair of door members comprises a first panel hingedly connected to a second panel, said second panel being hingedly mounted on a respective side of said opening.

5. Apparatus according to claim 1, wherein said container comprises the opening in the side wall thereof and a one or more doors is/are mounted across said opening.

6. Apparatus according to claim 1, wherein said container comprises a flatrack device, comprising open opposing sides.

7. Apparatus according to claim 1, wherein said container is formed of corrugated weathering steel.

8. Apparatus according to claim 1, wherein the base of said container is provided with a pair of fork pockets.

9. Apparatus according to claim 1, comprising a drive system provided within said container for rotating said spool about its longitudinal axis.

10. Apparatus according to claim 9, wherein the drive system comprises a hydraulic system, said hydraulic system additionally comprising hydraulic connectors.

11. Apparatus according to claim 10, wherein said container comprises an integral compartment for storing hydraulic connectors for said hydraulic system.

12. Apparatus according to claim 1, comprising a conduit within said container, said conduit having an inlet adjacent to said side wall of said container.

13. Apparatus according to claim 12, wherein the container comprises a water hydrant connector member for enabling a water hydrant to be connected thereto, said water hydrant connector member being communicably coupled to said inlet of the conduit; or wherein said conduit comprises one or more apertures configured to create jets of water when a pressurized water supply is applied at said inlet of said conduit.

14. Apparatus according to claim 1, wherein the container comprises one or more storage compartments; wherein a ladder is mounted or otherwise provided on said container, said ladder extending substantially vertically along a side wall of said container.

15. A method of manufacturing apparatus according to claim 1, comprising providing a rigid container externally shaped and configured to conform to the ISO 668 1C 2013-Series 1 freight containers International Standard, the container having at least a base and a pair of opposing end walls, and mounting on said base between said end walls, a spool on which is wound a flexible length of surface-covering roadway such that said spool is rotatable about its longitudinal axis within said container.

* * * * *